US008306232B2

(12) United States Patent
Lavry

(10) Patent No.: US 8,306,232 B2
(45) Date of Patent: Nov. 6, 2012

(54) DIGITAL AUDIO STEREO IMAGER

(75) Inventor: Dan Lavry, Rolling Bay, WA (US)

(73) Assignee: Lavry Engineering, Inc., Poulsbo, WA (US)

( * ) Notice: Subject to any disclaimer, the term of this patent is extended or adjusted under 35 U.S.C. 154(b) by 335 days.

(21) Appl. No.: 12/638,797

(22) Filed: Dec. 15, 2009

(65) Prior Publication Data

US 2010/0158257 A1 Jun. 24, 2010

Related U.S. Application Data

(60) Provisional application No. 61/138,655, filed on Dec. 18, 2008.

(51) Int. Cl.
*H04R 5/00* (2006.01)

(52) U.S. Cl. ..... 381/1; 381/119

(58) Field of Classification Search ..... 381/1, 119, 381/310, 309, 300, 74, 370, 307
See application file for complete search history.

(56) References Cited

U.S. PATENT DOCUMENTS

| | | | | |
|---|---|---|---|---|
| 5,402,501 | A * | 3/1995 | Silfvajt et al. | 381/119 |
| 6,782,108 | B2 * | 8/2004 | Shibata | 381/119 |
| 7,245,727 | B2 * | 7/2007 | Cresci et al. | 381/119 |
| 2005/0185806 | A1 * | 8/2005 | Salvador et al. | 381/119 |

* cited by examiner

*Primary Examiner* — Vivian Chin
*Assistant Examiner* — Con P Tran
(74) *Attorney, Agent, or Firm* — Christensen O'Connor Johnson Kindness PLLC

(57) ABSTRACT

An apparatus and a method for controlling, during playback, the composition of a pair of stereo separated audio signals in a stereo sound entertainment system by changing the stereo image width are disclosed. A digital mixer combines a portion of a first digital audio signal with a portion of a second digital audio signal to create a first mixed signal and a portion of the second digital audio signal with a portion of the first digital audio signal to create a second mixed signal. A listener controller independently controls, in accordance with a listener input, the portion of the first digital audio signal combined with the portion of the second digital audio signal and the portion of the second digital audio signal combined with the portion of the first digital audio signal.

27 Claims, 5 Drawing Sheets

DIGITAL AUDIO STEREO IMAGER

CROSS-REFERENCE TO RELATED APPLICATION

This application claims the benefit of Provisional Application No. 61/138,655, filed Dec. 18, 2008, which is incorporated herein by reference in its entirety.

BACKGROUND

Much of modern audio recording and listening is based on stereophonic sound, commonly called "stereo" or "surround sound." Stereophonic sound is the reproduction of sound, using two or more independent audio channels, through a symmetrical configuration of loudspeakers (speakers), in such a way as to create a pleasant and natural impression of sound heard from various directions, as in natural hearing. A stereo system offers the capability of reproducing at least some "sense of space," thus providing a listener with a more realistic reproduction of an original acoustic performance. Employing additional audio channels may enhance that capability. In popular usage, stereo usually means two-channel sound recording and sound reproduction using data for more than one speaker simultaneously. In technical usage, "stereo" or "stereophony" means sound recording and sound reproduction that uses stereographic projection to encode the relative positions of recorded objects and events. A stereo system can include any number of channels, such as the surround sound 5.1- and 6.1-channel systems. However, in common use it refers to systems with only two channels.

Normally, preparation of audio material for commercial distribution is done in a special listening environment, such as a mixing studio or mastering studio. The listening environment is typically equipped with audio speakers. An audio engineer can make many types of sonic adjustments while listening to the sound coming out of the speakers. One very important adjustment that can be made is called "sound separation," stereophonic sound attempts to create an illusion of location for various instruments within the original recording. The recording engineer's goal is usually to create a stereo "image" with localization information.

When playing back stereo recordings, the best results are obtained by using two speakers, located in front of and equidistant from the listener, with the listener located on the center line between, and facing, the two speakers. The listener's left ear has a more direct path to the left, and the right ear has a more direct path to the right speaker. When a stereophonic recording is heard through loudspeaker systems rather than headphones, each ear hears sound from both speakers. As in the case of a live musical performance, both ears react to sounds from all directions. Much of the sense of space is due to the relative amount of sound received by the left and right ear. An audio engineer may and often does use more than two microphones, sometimes many more, mixing the microphone signals down to two tracks. Typically, each audio stereo channel carries some of its own individual sound and also some sound that is common to both channels.

If all the sound in both channels is common, the system becomes a monophonic system resulting in loss of spatial perception. If the channels are totally separated, for example, when a listener is using headphones, proper spatial perception is lost. The resulting effect is distorted spatial perception. Headphones, therefore, introduce additional, unintended separation between the audio sound heard by listener's left and right ears. A signal out of a left speaker is intended to reach both ears, but with headphones, the same signal reaches only the left ear. Similarly, a signal out of a right speaker is intended to reach both ears, but with headphones, the same signal reaches only the right ear. Therefore, headphones result in added unintended stereo separation.

Significant differences between a recording environment, for example, a music production studio loudspeaker setup and a home listening environment setup, can also cause alterations between the intended spatial perception and the actual spatial perception in the home listening environment. Many home listening environments are set up in a way that is far from perfectly emulating an ideal listening studio stereo setup. Many factors, such room size, doors, windows, furniture location, etc., may cause a home listener to be located in a less then symmetrical listening position relative to the speakers. Thus, the spatial perception intended by a recording engineer in a recording (e.g., production studio) environment can be distorted in a home listening environment due to the differences between the studio and the home listening environments.

Therefore, there is a need for a system and method that allow a listener to control the composition of stereo separated audio signals in a sound entertainment system so as to enhance the listener's enjoyment by compensating for the distortions caused by the differences between recording and listening (e.g., home) environments.

SUMMARY

This summary is provided to introduce a selection of concepts in a simplified form that are further described below in the Detailed Description. This summary is not intended to identify key features of the claimed subject matter, nor is it intended to be used as an aid in determining the scope of the claimed subject matter.

An apparatus and a method for controlling, during playback, the composition of a pair of stereo separated audio signals in a stereo sound entertainment system by digitally changing the stereo image width are disclosed. The method and apparatus enhance an end user's (listener's) enjoyment by allowing the user to digitally mix the pair of stereo separated audio signals in a manner that compensates for the difference between a recording (e.g., studio production) environment and the user's listening environment. More specifically, during playback, a portion of one of the pair of stereo separated audio signals is digitally mixed with a portion of the other of the pair of stereo separated audio signals and vice versa prior to the resulting digitally mixed stereo audio signals being presented to the end user (listener).

In one exemplary illustrative embodiment, a stereo sound entertainment system apparatus for controlling, in accordance with a listener input, the composition of a pair of stereo separated audio signals is disclosed. The apparatus comprises: a digital mixer configured to receive two stereo separated, digital, audio signals, combine a portion of a first audio signal with a portion of a second audio signal to create a first mixed signal, and combine a portion of the second audio signal with a portion of the first audio signal to create a second mixed signal; and a listener controller coupled to the mixer and configured to independently control, in accordance with a listener input, the portion of the first audio signal combined with the portion of the second audio signal and the portion of the second audio signal combined with the portion of the first audio signal.

In one exemplary illustrative embodiment, the digital mixer comprises a multiplier arrangement and channel mixers. The multiplier arrangement is configured to: combine a portion of the first audio signal with the portion of a second audio signal by scaling the first audio signal by a first scaling factor and scaling the second audio signal by a second scaling factor related to the first scaling factor; and combine a portion of the second audio signal with a portion of the first audio signal by scaling the second audio signal by a third scaling factor and scaling the first audio signal by a fourth scaling factor related to the third scaling factor. The channel mixers mix the scaled audio signals to create the first mixed signal and the second mixed signal.

In another exemplary illustrative embodiment, the digital mixer comprises a computer processor and a memory having computer-executable instructions stored thereon, which, when executed by the computer processor, cause the computer processor to combine a portion of the first audio signal with a portion of the second audio signal to create the first mixed signal and combine a portion of the second audio signal with a portion of the first audio signal to create the second mixed signal.

In yet another exemplary illustrative embodiment, a method for controlling the composition of a pair of stereo separated audio signals in a stereo sound entertainment system in accordance with listener input is disclosed. The method comprises receiving two stereo separated, digital, audio signals and, in response to listener input, combining a portion of a first audio signal with a portion of a second audio signal to create a first mixed signal, and combining a portion of the second audio signal with a portion of the first audio signal to create a second mixed signal.

As will be readily appreciated from the foregoing summary, systems and methods that allow a listener to control, during playback, the composition of stereo separated audio signals in a sound entertainment system so as to enhance the listener's enjoyment by compensating for the distortions caused by differences between recording and listening environments are provided. While the systems and methods are ideally suited for use in a stereo headphone environment, the methods and systems may also find use in stereo speaker environments, both dual channel and multiple channel (i.e., surround sound) stereo speaker environments. The systems and methods enhance listener enjoyment by changing stereo image width. Depending on how a user controls the combination of the pair of stereo separated audio signals, the width of the resulting mixed signals can be increased or decreased.

DESCRIPTION OF THE DRAWINGS

The foregoing aspects and many of the attendant advantages of this invention will become more readily appreciated as the same become better understood by reference to the following detailed description, when taken in conjunction with the accompanying drawings, wherein.

DETAILED DESCRIPTION

Figure 1:
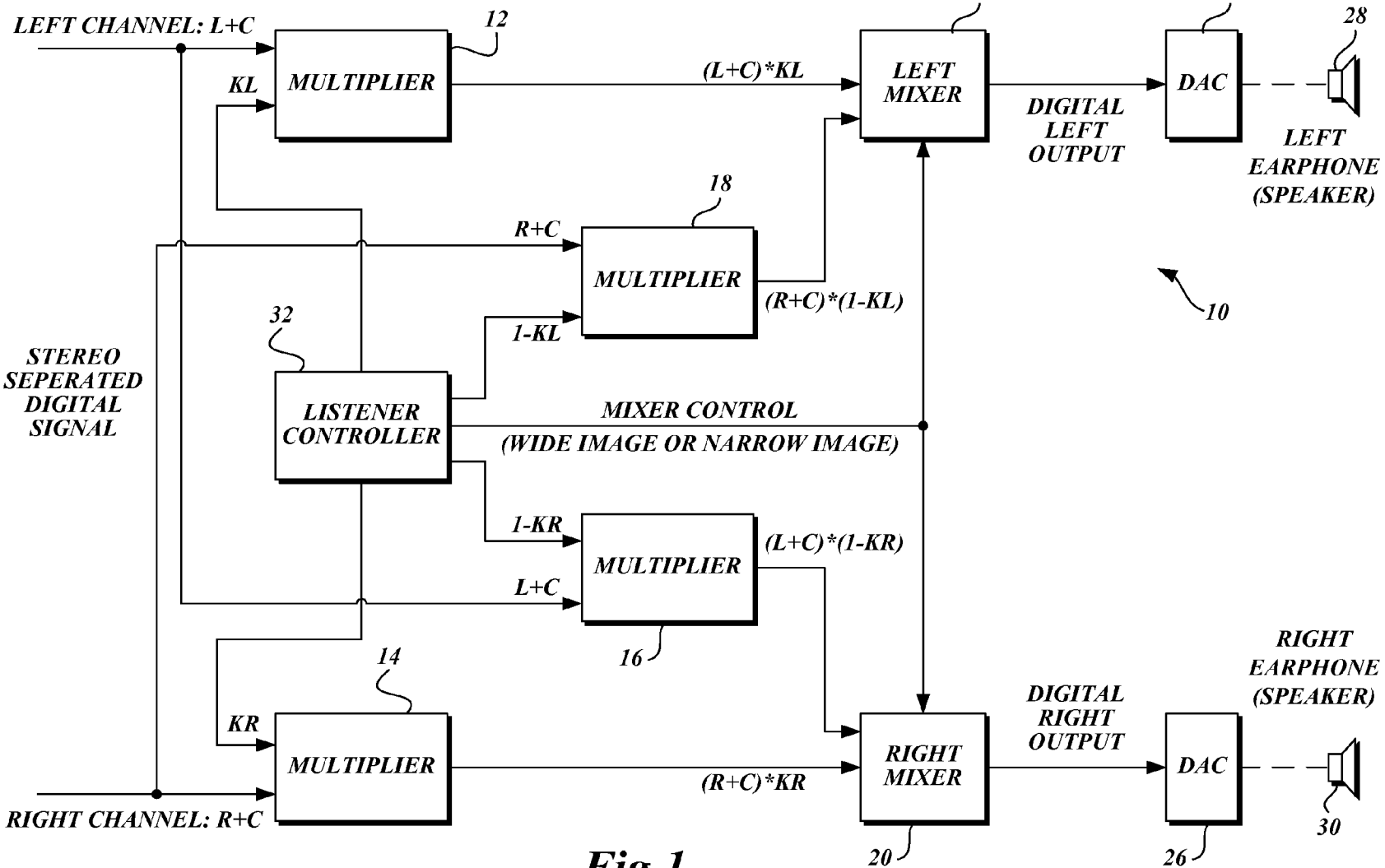
FIG. 1 is a block diagram illustrating an exemplary embodiment of an apparatus for controlling the composition of a pair of stereo separated audio signals in a stereo sound entertainment system.

As discussed above, listening to a stereo recording through headphones is often not as enjoyable as it could be due to the separation between the audio signals coming through "left" and "right" headphones. This undesirable playback result occurs because the left audio signal is completely isolated from the right audio signal and vice versa. Those skilled in the art will appreciate that "left" and "right" are used herein for ease of description and understanding only. This should be taken as exemplary and not limiting because, as those skilled in the art will appreciate, while the described systems and methods are ideally suited for use in a stereo headphone listening environment, the systems and methods may also find use in a speaker stereo environment, including speaker stereo environments that include more than two speakers, such as surround sound stereo speaker environments. Regardless of the listing environment, stereo sound distortion occurs during playback because the listening environment does not perfectly match the recording environment.

For the best playback listening enjoyment, each "channel" of a stereo listening environment (both headphone and speaker) should carry a mix of the channel's "own sound" and sound that is common to both channels blended in a way that recreates the "sense of space" of the original recording environment. In order to create the proper "sense of space" for a listener, it is necessary to be able to control the stereo image width of the audio signals in each channel. As will be better understood from the following description, this is accomplished by allowing a listener to control the ratio between common and individual sounds in each channel. In effect, changing the ratio between common and individual sounds in each channel controls the composition of the audio signal in each stereo sound channel.

Changing stereo image width is accomplished by electronically injecting (adding or subtracting) under listener control some of the signal from the right channel into the left channel and vice versa. That is, a user-selected portion of the signal that is common to both channels is added to, or subtracted from, each individual channel signal, in order to narrow or increase the stereo image width. This approach allows a user to compensate for the wide variation in taste between music producers, as well as variations in studio stereo setups and home setups.

The audio signal composition manipulation described above is accomplished by manipulating digital signals using appropriate hardware or software. More specifically, as more fully described below, during playback the audio digital signals in a stereo system, before their conversion into analog form and sent to earphones or loudspeakers, are altered under user control to create the desired stereo image width. Briefly, the stereo image width of each channel is controlled by creating intermediate mixed signals by adding a portion of the digital signal of one channel to the digital signal of the other channel or by subtracting a portion of the digital signal of the one channel from the digital signal of the other channel. The added or subtracted portion is controlled by the user. While both channel signals could be simultaneously adjusted, preferably each channel signal is separately adjusted. Scaling is used to maintain the resulting channel signals within a range that avoids distortion.

Stereo Image Width Reduction

Assume that L is the portion of a digital signal that appears only on the left channel, R is the portion of the digital signal that appears only on the right channel, and C is the portion of the digital signal that is common to both channels. Thus, the left channel signal is Left=L+C. The right channel signal is Right=R+C. Adding the left and right channel signal results in a SUM signal, namely, SUM=Left+Right=L+R+2*C. The SUM signal comprises two parts:

a. The (L+R) part is the portion containing the sum of the individual channel signals.

b. The (2*C) part is the portion of the signal common to both channels.

The SUM signal contains no separate L and R parts and represents a scaled monophonic signal that may be called a new common signal. The scaling factor depends on the original stereo signal separation.

Adding a portion KL of the SUM signal to the left channel signal, i.e., L+C, yields a new left channel signal, namely, New Left=L+C+KL*SUM=L+NewCL. Thus, the NewCL signal comprises the original common signal, C, and the additional common signal KL*SUM. In summary, the NewLeft signal comprises the same amount of separate signal L but an increased amount of a common signal, namely, NewCL.

Similarly, adding a portion KR of the SUM signal to the right channel signal i.e., R+C, yields a new right channel signal, namely, New Right=R+C+KR*SUM=R+NewCR. NewCR comprises the original common signal, C, and the additional common signal KR*SUM. Thus, the New Right signal comprises the same amount of separate signal R but an increased amount of a common signal, namely, NewCR.

In summary, the summation of the left and right channel digital signals yields a new common signal. Adding a desired portion of the new common signal to each channel "dilutes" the ratio of the separate portion (L or R) in each channel. Lowering the portions of separate L and R signals reduces the stereo separation. The amount of the SUM signal added to the left channel signal is controlled by the scaling factor KL, and the amount of the SUM signal added to the right channel signal is controlled by the scaling factor KR. While both channel signals can be controlled simultaneously and equally, by making KL=KR, preferably KL and KR are separately controlled by the listener.

Stereo Image Width Increase

As in the above example, assume L is the portion of the digital signal that appears only on the left channel, R is the portion of the digital signal that appears only on the right channel, and C is the portion of the digital signal that is common to both channels. Thus, again, the left channel signal is Left=L+C and the right channel signal is Right=R+C. The two channel signals can be subtracted from another to create a left channel difference signal (Diff_LR) and a right channel difference signal (Diff_RL) that eliminates the common portion of the signals. More specifically:

$$\text{Diff_}LR=(L+C)-(R+C)=L-R.$$

$$\text{Diff_}RL=(R+C)-(L+C)=R-L.$$

Adding a fraction KL of Diff_LR to the left signal yields a new left channel signal (New Left). More specifically, New Left=(L+C)+KL*(L−R)=(1+KL)*(L)+(C−KL*R). As a result, the separate portion of the left signal, i.e., L, is increased by a factor (1+KL). Also, the original common signal C is decreased by KL*R. Therefore, the proportion of L in the New Left signal has increased.

Similarly, adding a fraction KR of Diff_RL to R increases the portion of the separate signal R in a New Right signal.

In summary, subtractions of the left channel digital signal from the right channel digital signal and the right channel digital signal from left channel digital signal yield a pair of intermediate digital signals. Adding a portion of those signals to each channel increases the separate portion in each channel (R or L). The greater R and L portions of the respective channel signals enhance stereo sound separation.

Scaling

To avoid clipping, signals that are generated as a result of addition or subtraction of portions of signals should not exceed an allowed range. Given that the left and right channel signals alone may reach the maximum allowed signal value, summing portions of one channel signal within the other channel signal may exceed the allowed signal value. In order to prevent the resulting signal from exceeding the allowed signal value, it is necessary to scale down the components of the left and right channel signals.

Simply scaling, i.e., reducing a signal, such as a digital audio signal, below a certain value is undesirable because such scaling lowers the signal to noise ratio. For example, reduction of a signal by a factor of 2 is a loss of 1 bit (lowering the signal to noise ratio by 6.02 dB). A reduction by a factor of 4 is a loss of 2 bits (lowering the signal to noise ratio by 12.0 4 dB).

Better scaling yields a modified image width alteration signal that is near the original signal strength. Doing so maximizes the signal to noise ratio, which is one of the goals for a high quality audio system. If each signal component (Left or Right) can have a value as high as Vmax and as low as Vmin, both Left and Right must be scaled down by a factor of 2. The scaled addition yields SUM=1/2*Left+1/2*Right. Each resulting signal then will range between 1/2Vmax and' 1/2Vmin, ensuring that the sum will not exceed the available minimum to maximum range. Such scaling is sufficient to make sure that all the signals (intermediary and final signals) fit within the given range (Vmin to Vmax).

Exemplary Embodiments

Exemplary embodiments of systems for controlling stereo image width are described next. While the following description includes numerous specific details intended to provide a thorough understanding of the described embodiments, as will be apparent to those skilled in the art and others, some of these details may not be included in other embodiments and/or other details added.

FIG. 1 is a block diagram illustrating an exemplary control system 10 for controlling the composition of a pair of stereo separated audio signals in a stereo sound entertainment system. FIG. 1 also illustrates the flow of digital signals as they pass through control system 10. The control system 10 comprises four multipliers 12, 14, 16, and 18, a right mixer 20, a left mixer 22, a listener controller 32 and two digital-to-analog converters (DAC) 24 and 26. The control system 10 produces two outputs, which are separately applied to two earphones (or speakers) 28 and 30. As those skilled in the art and others will appreciate, the designation "left" and "right" are used for illustrative purposes only and should not be construed as limiting. As will also be understood by a person skilled in the art, the illustrated components of the control system 10 should not be construed as limiting since additional elements, such as, for example, amplifiers and filters, may be included in an actual embodiment. Further, the number of DACs in an actual embodiment may be more than the two depicted in FIG. 1. Also, a single multiplier unit that performs the functions of the four illustrated multipliers 12, 14, 16, and 18, or a single mixer that performs the functions of the two depicted mixers 20 and 22, may be included in an actual embodiment of the system shown in FIG. 1.

In accordance with user (listener) input, preferably manual input, the listener controller 32 generates the scaling factors KL and KR, which are applied to first and second multipliers 12 and 14, respectively. Based on the values of KL and KR established by the listener, the listener controller 32 also generates the value 1−KL, which is applied to the third multiplier 18, and the value 1−KR, which is applied to the fourth multiplier 16.

The left channel digital stereo signal, L+C, forms the second input to the first multiplier 12 and the right channel digital stereo signal, R+C, forms the second input to the second multiplier 14. The first and second multipliers 12 and 14 multiply the L+C signal by KL, and the R+C signal by KR, respectively. The first and second resulting signals are supplied to the left mixer 22 and the right mixer 20, respectively. The right channel signal, R+C, is also applied to the other input of the fourth multiplier 18, and left channel signal, L+C, is applied to the other input of the third multiplier 16. The signal that results from multiplying 1−KL and R+C, i.e., the output of the fourth multiplier 18, is applied to the left mixer 22, and the signal that results from multiplying R+C and 1−KL, i.e., the output of the third multiplier 16, is applied to the right mixer 20. The outputs of the left and right mixers 22 and 20 are separately applied to the inputs of the two digital-to-analog converters 24 and 26. The outputs of the two digital-to-analog converters are applied to the left and right earphones (or speakers) 28 and 30, respectively, via suitable power amplifier and filter circuitry.

Figure 2:
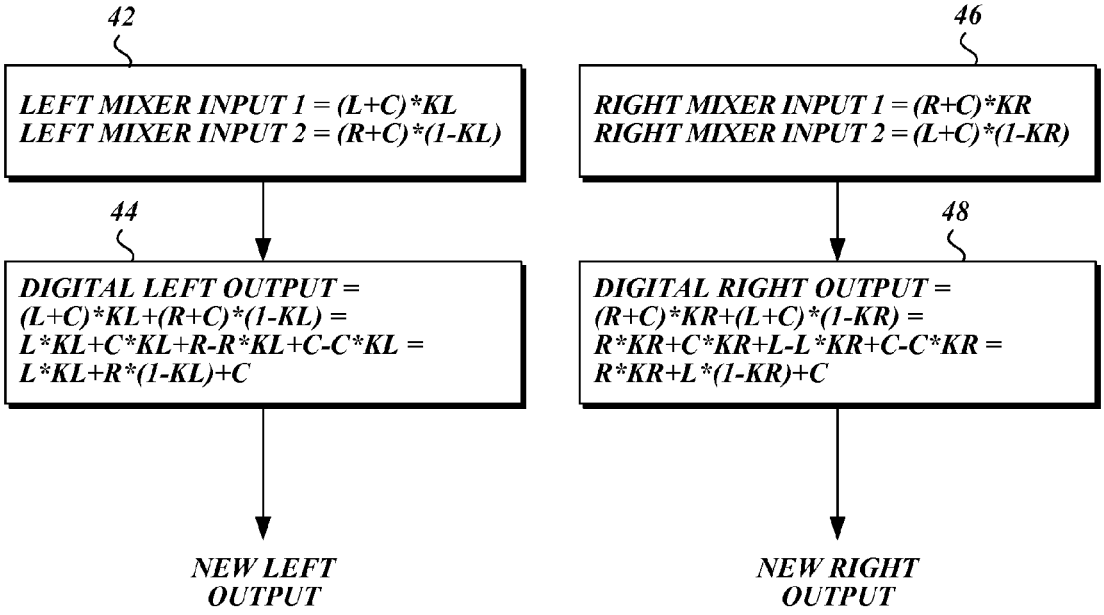
FIG. 2 is a functional diagram illustrating an exemplary routine performed by a mixer configured to decrease, i.e., reduce, stereo image width.

FIG. 2 illustrates the mathematical functions performed by the left and right mixers 22 and 20 when the width of a stereo image is being reduced. Block 42 illustrates the two signals received by the left mixer 22, i.e., (L+C)*KL and (R+C)*(1−KL), and block 46 illustrates the two signals received by the right mixer 20, i.e., (R+C)*KL and (L+C)*(1−KR). Blocks 44 and 48 illustrate the mathematical functions performed by the left and right mixers to produce the left and right channel digital outputs that are applied to the DACs 24 and 26, respectively, namely, (L+C)*KL+(R+C)*(1−KL)=L*KL+C*KL+R−R*KL+C−C*KL=L*KL+R*(1−KL)+C and (R+C)*KR+(L+C)*(1−KR)=R*KR+C*KR+L−L*KR+C−C*KR=R*KR+L*(1−KR)+C.

Figure 3:
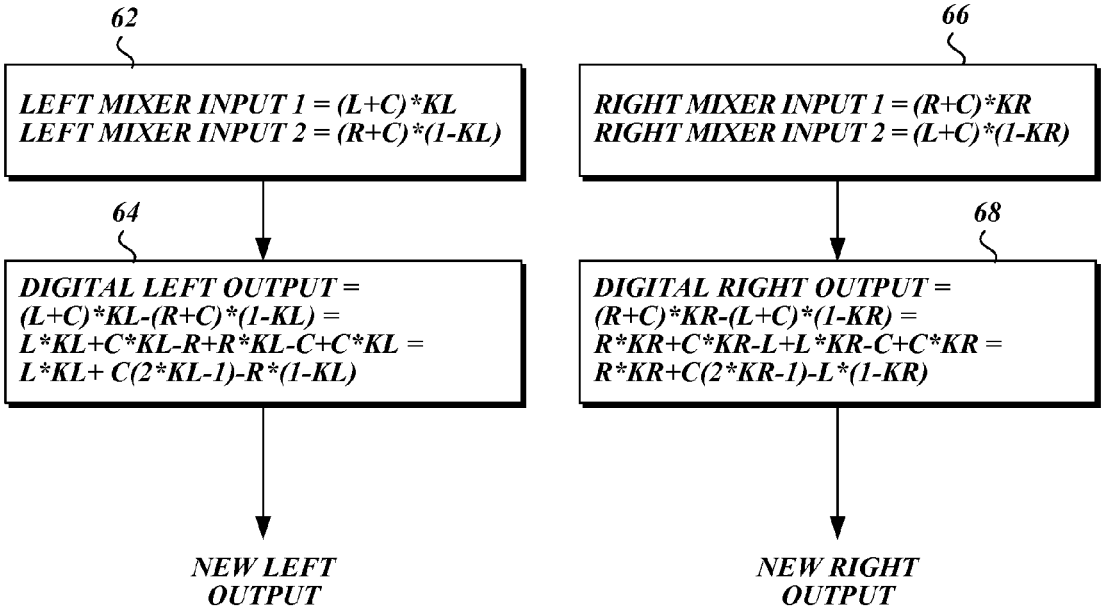
FIG. 3 is a functional diagram illustrating an exemplary routine performed by a mixer configured to increase stereo image width.

Similarly, FIG. 3 illustrates the mathematical function performed by the left and right mixers 22 and 20 when the width of a stereo image width is being increased. As with FIG. 2, blocks 62 and 66 illustrate the signals received by the left and right mixers 22 and 20, respectively, namely, (L+C)*KL and (R+C)*(1−KL), and (R+C*KR and (L+C)*(1−KR). Blocks 64 and 68 illustrate the mathematical functions performed by the left and right mixers to produce the left and right channel digital outputs that are applied to the DACs 24 and 26, respectively, namely (L+C)*KL−(R+C)*(1−KL)=L*KL+C*KL−R+R*KL−L+L*KL=L*KL+C (2*KL−1)−R*(1−KL) and (R+C)*KR−(L+C)*(1−KR)=R*KR+C*KR−L+L*KR−C+C*KR=R*KR+C(2*KR−1)−L*(1−KR).

Returning to FIG. 1, as noted above, the output signals of left and right mixers 22 and 20 (illustrated by blocks 44 and 48 in case of reducing the stereo image width and illustrated by blocks 64 and 66 in the case of increasing stereo image width) are applied to the left and right digital-to-analog converters 24 and 26.

Figure 4:
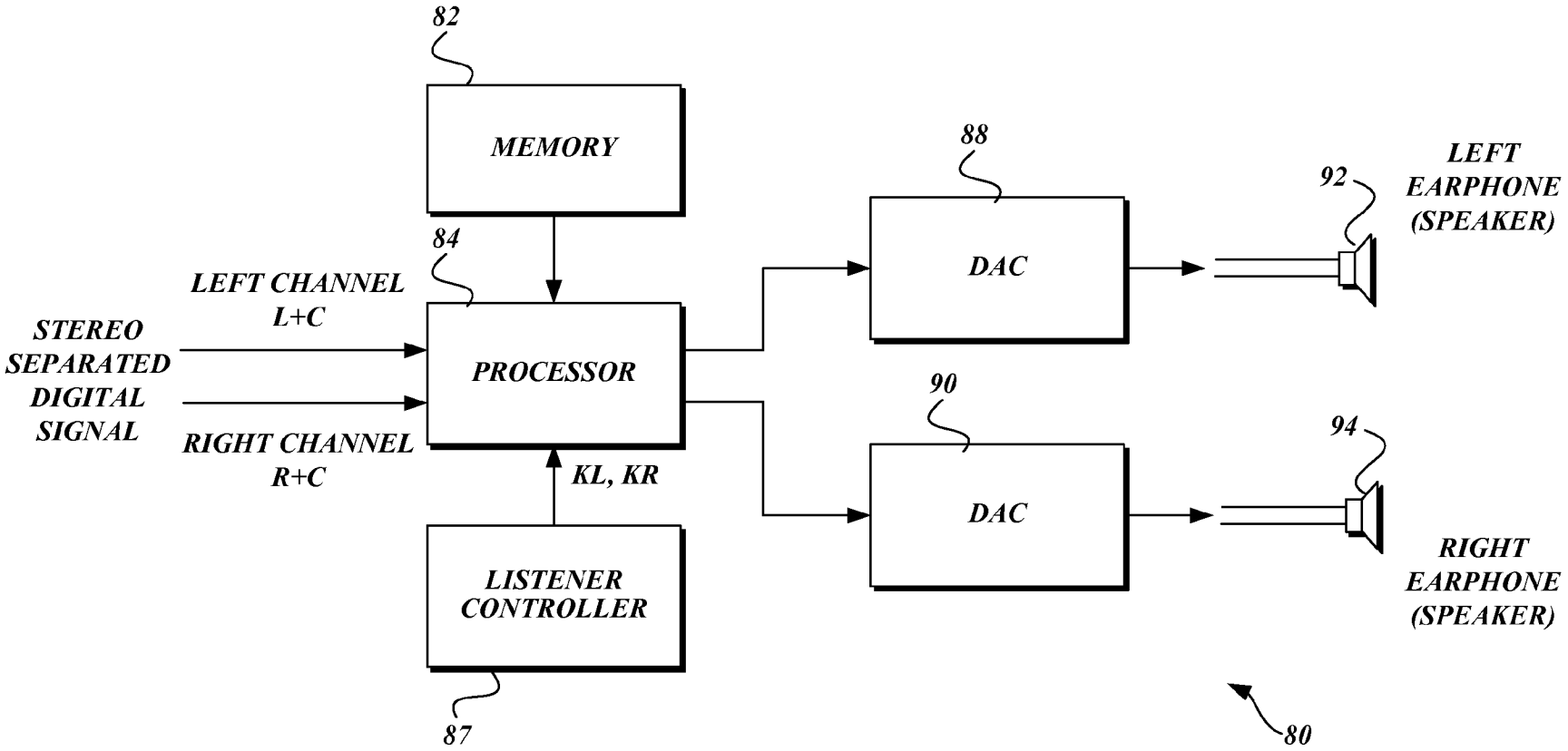
FIG. 4 is a block diagram illustrating another embodiment of an apparatus for controlling the composition of a pair of stereo separated audio signals in a stereo sound entertainment system.
Figure 5:
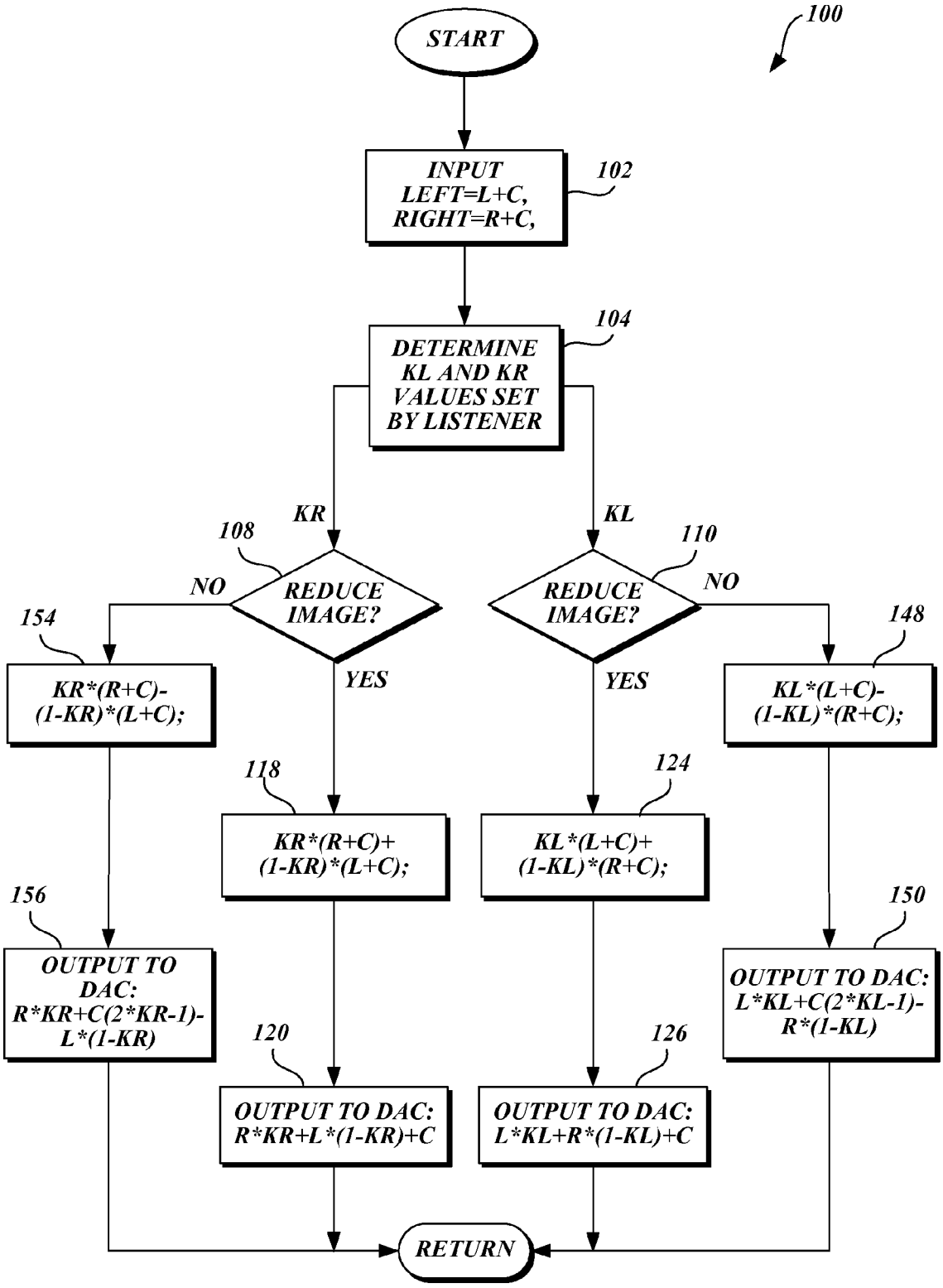
FIG. 5 is a functional flow diagram illustrating an exemplary routine for controlling the stereo image width suitable for use by the system illustrated in FIG. 4.

Those skilled in the art will appreciate that the essentially hardware embodiment illustrated in FIG. 1 can also be performed by a software program executed by a computer processing device. FIGS. 4-5 illustrate such an alternative embodiment, i.e., an exemplary embodiment wherein the digital signal manipulation described above is performed by software stored in the memory of a computing device when executed by a processor.

FIG. 4 illustrates an exemplary embodiment of a stereo system that incorporates a computing device 80 for controlling stereo image width. The computing device comprises a processor 84 coupled to a memory 82 suitable for storing a program that performs the functions illustrated in FIG. 5 and described below when the program is executed by the processor. Those skilled in the art will recognize that a variety of computer-readable storage medium may be used to form the memory—random access memory (RAM), flash memory, etc. A listener controller 86 provides a user (listener) interface to the processor 84. The listener controller is used by the listener to set the values of the scale factors KL and KR. The processor also receives the left channel signal, L+C, and the right channel signal, R+C. Signal transformation is controlled by the software program stored in the memory 82 when the program is executed by the processor 84. The resulting left and right channel signals are applied to left and right digital-to-analog converters (DACs) 88 and 90.

FIG. 5 is a functional flow diagram 100 that illustrates how the left and right channel digital signal are manipulated by the processor 84 when the software program stored in the memory 82 is executed by the processor. At block 102 the processor receives the left channel digital signal L+C and the right channel digital signal R+C. Next, at decision block 104 the processor determines the values of the scaling factors KL and KR set by the listener. These values are stored in the memory 82 (FIG. 4). The values of KL and KR determine subsequent processing either in parallel, as shown, or in series. Regardless of the order, at block 108 the process determines which type of signal calculation should be performed on the right channel signal, i.e., whether the right channel image width should be increased or decreased If the value of RL indicates that image width should be reduced, at blocks 118 and 120 the right channel signal is modified, i.e., reduced, in accordance with the previously described equations [KR*(R+C)+(1−KR*(L+C))] to create the signal R*KR+L*(1−KR)+C, which is applied to the right channel digital-to-analog converter 90 (FIG. 4).

If the test at block 108 determines that the right channel signal width is to be increased, at blocks 154 and 156 the right channel signal is reduced in accordance with the previously described equations [KR*(R+C)+(1−KR)*(L+C)] to create the signal R*KR+C(2*KR−1)−2*(1−KR), which is applied to the right channel digital-to-analog converter 90.

At block 110, the process determines which type of calculation should be performed in the left channel signal, i.e., whether the left channel image width should be increased or decreased. If the value of KL indicates that the left channel image width should be decreased (i.e., reduced), the left channel signal is modified, i.e., reduced in accordance with the previously described equation [KL*(L+C)+(1−KL*(R+C)] to create the signal L*KL+(1−KL)+C, which is applied to the left channel digital-to-analog converter 88 (FIG. 4).

If the test at block 110 determines that the left channel signal width is to be increased, at blocks 148 and 150 the left channel signal is increased in accordance with the previously described equation [KL*(L+C)+(1−KL)*(R+C)] to create the signal L*K*L+C (2*KL−1)−R*(1−KL), which is applied to the left channel digital-to-analog converter 88.

As previously described, the outputs of the left and right digital-to-analog converters 88 and 90 are applied to left and right earphones (or speakers) 92 and 94.

Figure 6:
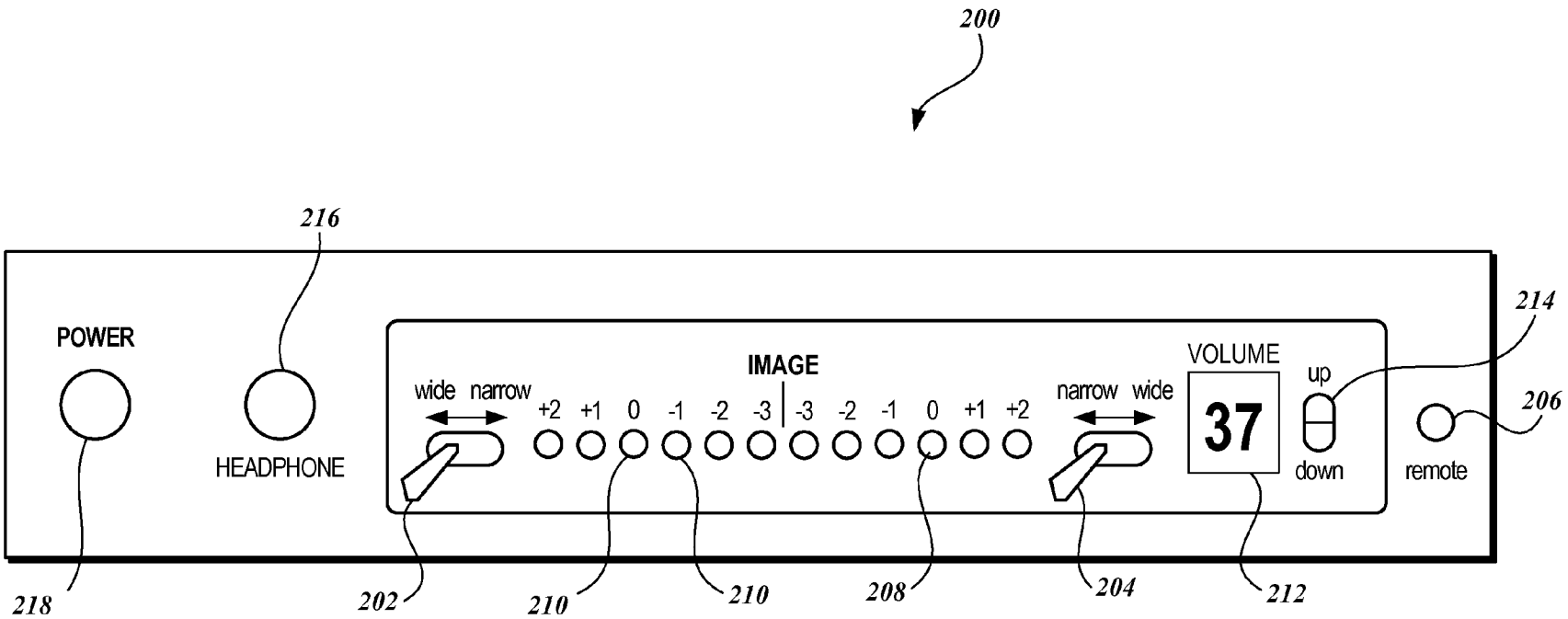
FIG. 6 is a pictorial diagram illustrating a front panel of an exemplary stereo sound entertainment system that incorporates an apparatus for controlling the composition of a pair of stereo separated audio signals.

FIG. 6 illustrates an exemplary front panel 200 of a stereo system that incorporates a control system for controlling the composition of a pair of stereo separated audio signals as described above. Left and right momentary contact toggle switches 202 and 204 are used to set the widening (increasing) or narrowing (reducing) of the left and right audio channels. As those skilled in the art will appreciate, a number of different ways to set the widening and narrowing of stereo image other than the way shown in FIG. 6 and described herein can be employed. For example, an infrared ("IR") remote control device (not shown) can be employed to set the stereo system 200 via an IR receiver 206 shown by way of example at the right side of the front panel 200.

In the case of the illustrated toggle switch control embodiment, each toggle of the right channel toggle switch 204 to the right causes the next indicator lamp 208 of a right set of indicator lamps to the next right position to light and the prior indicator lamp to go off, until the widest position is reached. Each toggle of the right channel toggle switch 204 to the left causes the next indicator lamp 208 to the next left position to light and the prior indicator lamp to go off, until the narrowest position is reached. In this regard, −3, −1, −1, 0, +1, and +2 right relative indicator lamps are illustrated. Obviously, more or less relative indicator lamps can be used in other embodiments of this invention. The numbers are relative in the sense that they are step functions that do not, per se, identify specific values. As noted by the "wide narrow" terminology over the right toggle switch 204 when compared to the right channel −3, −2, −1, 0, +1, and +2 lamp identifiers, the −3, −2, and −1 lamp indicators denote a relative narrowing of the right channel image, 0 is neutral (no widening or narrowing), and +1 and +2 indicate a relative widening of the right channel image.

Each toggle of the left channel toggle switch 202 to the left causes the next indicator lamp of a left set of indicator lamps 210 to the next left position to light and the prior indicator lamp to go off, until the widest position is reached. Each toggle of the left channel toggle switch to the right causes the next indicator lamp 210 to the next right position to light and the prior indicator lamp to go off, until the narrowest position is reached. In this regard, as with the right relative indicator lamps, +2, +1, 0, −1, −2, and −3 left relative indicator lamps are illustrated. Obviously, more or less relative indicator lamps can be used in other embodiments of the invention. The numbers are relative in the sense that they are step functions that do not, per se, identify specific values. As noted by the "narrow wide" terminology over the left toggle switch 202, when compared to the left channel +2, +1, 0, −1, −2, and −3 lamp identifiers, the −3, −2, and −1 lamp indicators denote a relative narrowing of the left channel image, 0 is neutral (no widening or narrowing), and +1 and +2 indicate a relative widening of the left channel image.

As noted above, the numeric indicator values (+2, +1, 0, −1, −2 and −3) are relative values that identify specific add/subtract SUM factors for controlling stereo image width. The factors represented by the related lit indicator are stored in memory for use by the herein described embodiments of the inventions.

In addition to the left and right toggle switches 202 and 204 and the left and right sets of indicator lamps 210 and 208, the front panel 200 also has a volume display 212 that displays a number that represents the output volume setting of the stereo system. The volume setting is controlled by an up/down toggle switch 214. The front panel 200 also includes a headphone jack 216 for connecting the stereo system to the left/right earpieces of a headphone and a power button 218 for controlling the on/off state of the stereo system. As denoted by indicator arrows located above the toggle switches, one of the toggle switches is a three-position toggle switch whose state determines which of the left and right channels is enabled for changing when the toggle switch is up or down, the center position being a neutral (no enablement) position.

While illustrative embodiments have been illustrated and described, it will be appreciated that various changes can be made therein without departing from the spirit and scope of the invention. For example, the toggle switches can be replaced by push button or rotary switches. Or, as noted above, more or fewer than six relative wide/narrow indicators and related values can be used in an actual embodiment of the invention. If desired, rather than incremental values, a continuous spread of values can be provided in a rotary dial switch embodiment, for example. Hence, within the scope of the appended claims, it is to be understood that the invention can be practiced otherwise than as specifically described herein.

The embodiments of the invention in which an exclusive property or privilege is claimed are defined as follows:

1. In a stereo sound entertainment system, apparatus for digitally controlling, during playback, in accordance with listener input, the composition of a pair of pre-recorded stereo separated audio signals, the apparatus comprising:

(a) a digital mixer configured to:
  (i) receive two pre-recorded stereo separated, digital audio signals;
  (ii) combine a portion of a first digital audio signal of the two pre-recorded stereo separated digital audio signals with a portion of a second digital audio signal of the two pre-recorded stereo digital audio signals to create a first mixed signal; and
  (iii) combine a different portion of the second digital audio signal with a different portion of the first digital audio signal to create a second mixed signal; and (b) a listener controller coupled to said digital mixer configured to independently control, in accordance with listener input:
  (i) the portion of the first digital audio signal combined with the portion of the second digital audio signal; and
  (ii) the different portion of the second digital audio signal combined with the different portion of the first digital audio signal.

2. The apparatus of claim 1, wherein:

(a) combining the portion of the first digital audio signal with the portion of the second digital audio signal to create the first mixed signal comprises:
  (i) scaling the first digital audio signal by a first scaling factor;
  (ii) scaling the second digital audio signal by a second scaling factor related to the first scaling factor; and
  (iii) mixing the scaled digital audio signals to create the first mixed signal;

(b) combining the different portion of the second digital audio signal with the different portion of the first digital audio signal to create the second mixed signal comprises:
  (i) scaling the second digital audio signal by a third scaling factor;
  (ii) scaling the first digital audio signal by a fourth scaling factor related to the third scaling factor; and
  (iii) mixing the scaled digital audio signals to create the second mixed signal; and (c) the magnitudes of the first and third scaling factors are controlled by the listener controller in accordance with listener input.

3. The apparatus of claim 2, wherein the second scaling factor is related to the first scaling factor by subtracting the first scaling factor from a first predetermined value.

4. The apparatus of claim 2, wherein the fourth scaling factor is related to the third scaling factor by subtracting the third scaling factor from a second predetermined value.

5. The apparatus of claim 2, wherein mixing the scaled digital audio signals comprises adding the scaled audio signals to each other.

6. The apparatus of claim 2, wherein mixing the scaled digital audio signals comprises subtracting the scaled audio signals from each other.

7. The apparatus of claim 1, wherein the digital mixer comprises:

(a) a first multiplier for multiplying the first audio digital signal by a first scale factor;

(b) a second multiplier for multiplying the second audio digital signal by a second scale factor;

(c) a first channel mixer for mixing the outputs of the first and second multipliers to create the first mixed signal;

(d) a third multiplier for multiplying the second digital audio signal by a third scale factor;

(e) a fourth multiplier for multiplying the first digital audio signal by a fourth scale factor; and (f) a second channel mixer for mixing the outputs of the third and fourth multipliers to create the second mixed signal.

8. The apparatus of claim 7, wherein the second scaling factor is related to the first scaling factor by subtracting the first scaling factor from a first predetermined value.

9. The apparatus of claim 7, wherein the fourth scaling factor is related to the third scaling factor by subtracting the third scaling factor from a second predetermined value.

10. The apparatus of claim 1, wherein the digital mixer comprises a computer processor and a memory having computer-executable instructions stored thereon which, when executed on the computer processor, cause the computer processor to perform the combining of the portion of the first digital audio signal with the portion of the second digital audio signal to create the first mixed signal and the combining of the different portion of the second digital audio signal with the different portion of the first digital audio signal to create the second mixed signal.

11. The apparatus of claim 10, wherein:

(a) combining the portion of a first digital audio signal with the portion of a second audio signal to create the first mixed signal comprises:

(i) scaling the first digital audio signal by a first scaling factor;

(ii) scaling the second digital audio signal by a second scaling factor related to the first scaling factor; and (iii) mixing the scaled audio signals to create the first mixed signal;

(b) combining the different portion of the second digital audio signal with the different portion of the first audio signal to create the second mixed signal comprises:

(i) scaling the second digital audio signal by a third scaling factor;

(ii) scaling the first digital audio signal by a fourth scaling factor related to the third scaling factor; and (iii) mixing the scaled audio signals to create the second mixed signal; and (c) the magnitudes of the first and third scaling factors are controlled by the listener controller in accordance with a listener input.

12. The apparatus of claim 11, wherein the second scaling factor is related to the first scaling factor by subtracting the first scaling factor from a first predetermined value.

13. The apparatus of claim 11, wherein the fourth scaling factor is related to the third scaling factor by subtracting the third scaling factor from a second predetermined value.

14. A method for controlling, during playback, the composition of a pair of pre-recorded stereo separated audio signals in a stereo sound entertainment system in accordance with listener input, comprising:

(a) receiving two pre-recorded stereo separated digital audio signals; and (b) in response to listener input, (i) combining a portion of a first digital audio signal of the two pre-recorded stereo separated digital audio signals with a portion of a second digital audio signal of the two pre-recorded stereo separated digital audio signals to create a first mixed signal; and (ii) combining a different portion of the second digital audio signal with a different portion of the first digital audio signal to create a second mixed signal.

15. The method of claim 14, wherein:

(a) combining the portion of the first digital audio signal with the portion of the second digital audio signal to create the first mixed signal comprises:

(i) scaling the first digital audio signal by a first scaling factor;

(ii) scaling the second digital audio signal by a second scaling factor related to the first scaling factor; and (iii) mixing the scaled digital audio signals to create the first mixed signal; and (b) combining the different portion of the second digital audio signal with the different portion of the first digital audio signal to create the second mixed signal comprises:

(i) scaling the second digital audio signal by a third scaling factor;

(ii) scaling the first digital audio signal by a fourth scaling factor related to the third scaling factor; and (iii) mixing the scaled digital audio signals to create the second mixed signal.

16. The method of claim 15, wherein the first scaling factor and the third scaling factors are controlled by the listener input.

17. The method of claim 15, wherein the second scaling factor is related to the first scaling factor by subtracting the first scaling factor from a first predetermined value.

18. The method of claim 15, wherein the fourth scaling factor is related to the third scaling factor by subtracting the third scaling factor from a second predetermined value.

19. The method of claim 15, wherein mixing the scaled digital audio signals to create the first mixed signal comprises adding the first scaled digital audio signal to the second scaled digital audio signal.

20. The method of claim 15, wherein mixing the scaled digital audio signals to create the second mixed signal comprises adding the third scaled digital audio signal to the fourth scaled digital audio signal.

21. The method of claim 15, wherein mixing the scaled digital audio signals to create the first mixed signal comprises subtracting the second scaled digital audio signal from the first scaled digital audio signal.

22. The method of claim 15, wherein mixing the scaled digital audio signals to create the second mixed signal comprises subtracting the fourth scaled digital audio signal from the third scaled digital audio signal.

23. The method of claim 15, wherein the first and third scaling factors are the same.

24. The method of claim 15, wherein the first and third scaling factors are different.

25. The method of claim 15, wherein the second and fourth scaling factors are created by subtracting, respectively, the first scaling factor from a first predetermined value and the third scaling factor from a second predetermined value.

26. The method of claim 25, wherein the first and second predetermined values are the same.

27. The method of claim 25, wherein the first and second predetermined values are one ("1").

* * * * *